US006079129A

United States Patent [19]

Bourdeau et al.

[11] Patent Number: 6,079,129

[45] Date of Patent: Jun. 27, 2000

[54] BOOT FOR GLIDING SPORTS

[75] Inventors: Joel Bourdeau, Saint-Jorioz; Vincent Forest, Annecy, both of France

[73] Assignee: Salomon S.A., Metz-Tessy, France

[21] Appl. No.: 09/122,377

[22] Filed: Jul. 27, 1998

Related U.S. Application Data

[63] Continuation of application No. 08/692,402, Aug. 5, 1996, abandoned, which is a continuation of application No. 08/431,296, Apr. 28, 1995, abandoned.

[30] Foreign Application Priority Data

Apr. 29, 1994 [FR] France ..... 94.05408

[51] Int. Cl.[7] ..... A43B 5/04

[52] U.S. Cl. ..... 36/118.2; 36/115; 36/118.8; 36/119.1

[58] Field of Search ..... 36/115, 117.1, 36/118.2, 118.7, 118.8, 119.1

[56] References Cited

U.S. PATENT DOCUMENTS

| | | | |
|---|---|---|---|
| 3,584,622 | 6/1971 | Domenico | 36/2.5 X |
| 3,732,635 | 5/1973 | Marker | 36/2.5 |
| 3,824,713 | 7/1974 | Vaccari | 36/118 |
| 4,453,727 | 6/1984 | Bourque | 36/115 X |
| 4,979,760 | 12/1990 | Derrah | 36/120 X |
| 5,090,138 | 2/1992 | Borden | 36/89 X |
| 5,177,884 | 1/1993 | Rullier | 36/117 |
| 5,401,041 | 3/1995 | Jespersen | 280/14.2 X |
| 5,408,763 | 4/1995 | Sartor et al. | 36/115 |
| 5,491,911 | 2/1996 | Chen | 36/115 X |
| 5,771,609 | 6/1998 | Messmer | 36/89 |

FOREIGN PATENT DOCUMENTS

| | | |
|---|---|---|
| 0813825 | 12/1997 | European Pat. Off. . |
| 964740 | 8/1950 | France . |
| 3622746 | 1/1988 | Germany . |
| 4333503 | 4/1995 | Germany . |
| 92A/01237 | 5/1992 | Italy . |

*Primary Examiner*—Paul T. Sewell
*Assistant Examiner*—J. Mohandesi
*Attorney, Agent, or Firm*—Greenblum & Bernstein, P.L.C.

[57] ABSTRACT

A boot for the practice of a sliding sport, such as snowboarding. The boot includes, in particular, a relatively rigid shell and a relatively rigid collar, the collar being articulated to the shell about an axis extending in a substantially longitudinal plane of the boot. A relatively flexible upper is received in the shell and has an upper part enclosing the lower leg.

37 Claims, 5 Drawing Sheets

1

13
16
14
4
12
15
24
7
17
3
18
20
11
21
6
5
2
9
10

16
14
4
15
22
17
20
23
19
21
2
24
8
5
7
10
6
9
11

BOOT FOR GLIDING SPORTS

CROSS-REFERENCE TO RELATED APPLICATIONS

This is a continuation of application Ser. No. 08/692,402, filed on Aug. 5, 1996, now abandoned, which is a continuation of application No. 08/431,296, filed on Apr. 28, 1995, now abandoned, the disclosures of all of which are hereby incorporated by reference thereto in their entireties, and the priorities of which are claimed under 35 USC 120.

This application is also based upon French application No. 94 05408, filed on Apr. 29, 1994, the disclosure of which is hereby incorporated by reference thereto in its entirety and priority of which is hereby claimed under 35 USC 119.

BACKGROUND OF THE INVENTION

1. Field of the Invention

The present invention relates to a boot designed for sliding sports and, in particular, a boot for snow "surfing", i.e., snowboarding, or other sliding sports having similar requirements.

2. Description of Background and Material Information

In general, it is necessary that a user enjoys a certain level of comfort and that specific parts of the foot or leg of the user are held in position or guided, in order to enable the user to adopt various positions without impediment, depending upon the circumstances encountered during the sliding motion.

The user's positions correspond to the technique normally used for snowboarding.

Considered schematically, a snowboard may be compared with a board of which the two opposite sides extending lengthwise make it possible to gain and control points of support on the snow.

The user's feet are attached to the board by means of his boots in such a way that the ends of the feet are positioned in proximity to one side and the heels are positioned in proximity to the opposite side.

Accordingly, the user's feet extend substantially transversely to the board.

As a result, the engagement of an edge on the longitudinal side dictates that the leg be firmly held in place in the lengthwise direction in which the foot extends. In this case, any movement of longitudinal flection of the leg in relation to the foot must be prevented, or at least attenuated.

Furthermore, variations of the inclination of the relief or changes of direction force the user to bend his legs to maintain balance or to steer the board.

In general, the legs are bent substantially in the direction of the lengthwise dimension of the board, i.e., laterally in relation to the foot. In this case, the leg must be able to bend to either side in relation to the foot.

The boots currently used may be classified into two categories: flexible boots and rigid or semi-rigid boots.

Flexible boots allow the leg to bend in all directions in relation to the foot, i.e., under both longitudinal and lateral flection, or in a position which combines these two directions of inclination.

These boots have the disadvantage of requiring the user to supply significant force when the edges grip the snow, in order to keep the foot in position in relation to the leg. In fact, edge engagement occurs on a single longitudinal side. The board is then supported on this single side, and the user must supply the force needed to hold it in the desired position in relation to the slope. The leg muscles undergo a high level of stress, thereby fatiguing the snowboarder and impeding him considerably.

The rigid or semi-rigid boots comprise a collar which surrounds the lower leg and allows the user to keep the board in the edge-gripping position without fatigue. However, these boots do not allow lateral flection around the ankle, thereby preventing the user from maneuvering correctly so as to preserve his balance or steer the board. The rigidity of the boot requires the wearer to effect movements of an exaggerated amplitude using the chest and the arms, in order to compensate for the lack of lateral mobility of the legs.

Consequently, no present-day boot proves entirely satisfactory, since no boot allows the user to be at ease in all of the circumstances encountered during snowboarding.

SUMMARY OF THE INVENTION

The present invention is intended to solve these problems and to supply an improved boot for use in sliding sports and, more particularly, one suited for snowboarding or other sliding sports exhibiting substantially the same constraints.

To this end, the invention proposes a structure enabling the user to control the movements to be performed in snowboarding or other sliding sports without fatigue or pain.

The boot according to the invention comprises, in particular, a sole designed to be connected to a sliding device, such as a snowboard, and a collar which holds the ankle in place and is jointed by a connection device to a structurally similar part fastened to the sole, and the connection device is a pivot pin whose axis lies in a substantially longitudinal plane of the boot.

Moreover, the axis of the pivot pin preferably extends in a substantially horizontal direction.

A boot of this kind solves the problems raised by prior art boots, since it allows good longitudinal position-retention of the foot in relation to the leg, while allowing a lateral inclination of the leg on one side or the other of the foot.

The user may execute all movements required for the practice of his sport, without undue fatigue or any particular impediment.

BRIEF DESCRIPTION OF THE DRAWINGS

Other features and advantages of the invention will be better understood from the following description provided with reference to the attached drawings illustrating, by way of a non-limiting example, an embodiment the invention, in which.

DETAILED DESCRIPTION OF THE INVENTION

Figure 1:
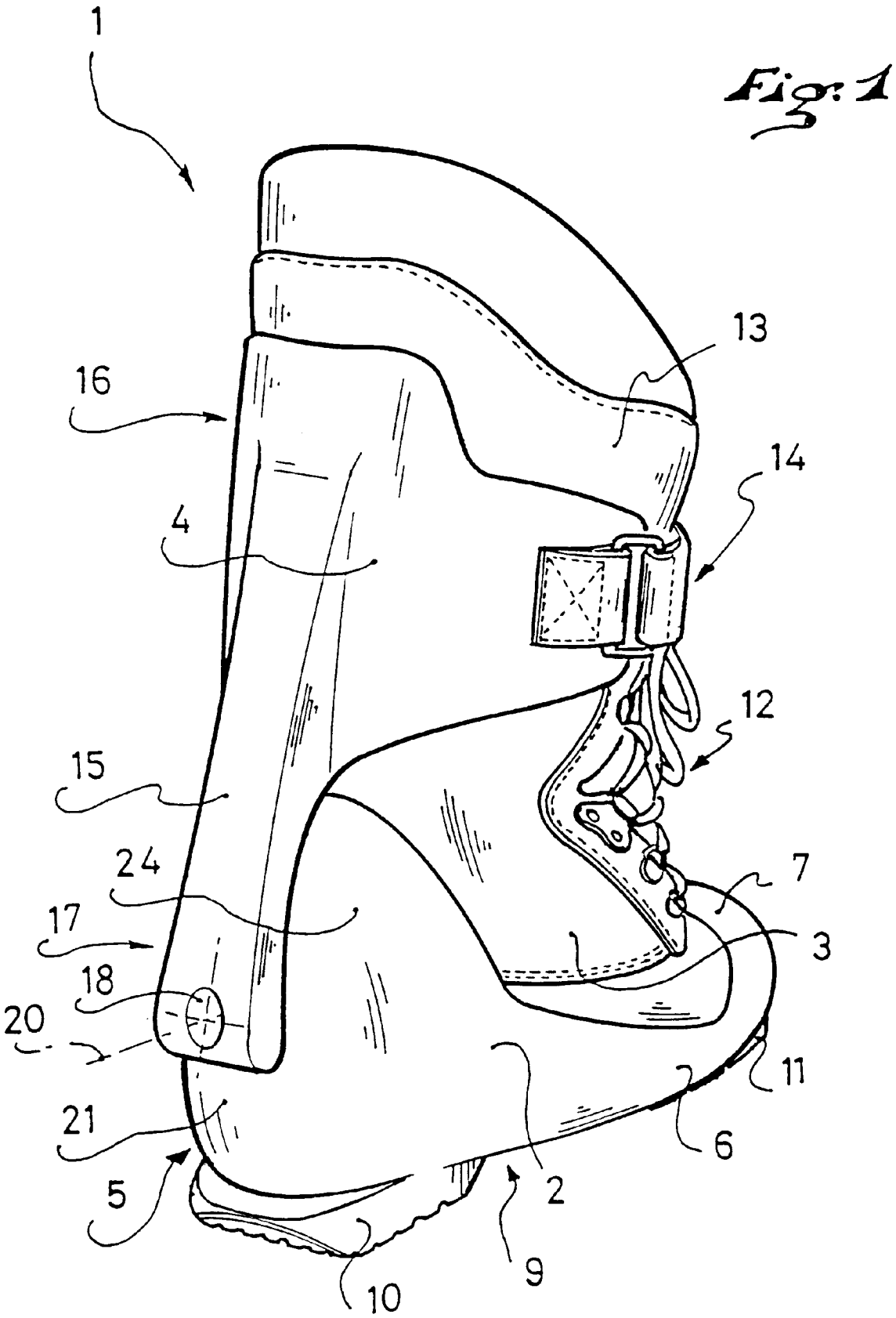
FIG. 1 is a rear three-quarter perspective view of a boot according to the invention.

FIG. 1 illustrates a boot 1 designed, more particularly, for snowboarding. The boot 1 comprises, in particular, a shell 2, an upper 3, and a collar 4.

The shell 2 comprises a heel part or heel-piece 5, an outer lateral wall 6, a front end 7, an inner lateral wall 8 (not shown in FIG. 1), and a sole 9.

The heel-piece 5, the walls 6 and 8, and the front end 7 form a relatively rigid band, which is fastened to the sole 9, in which a front and rear raised area 10 and 11 constitute zones supporting the boot 1 on the ground when walking, or on the board when sliding.

The band 5, 6, 7, 8 and the sole 9 may be attached using any method, e.g., riveting, adhesive bonding, or other means. The band and the sole 9 may also form a one-piece unit produced, for example, by injection of a plastic material.

In any case, the shell 2 produced by attaching the band to the sole 9 will be relatively rigid.

The shell 2 receives the upper 3, which it holds in place by means of the band, described above. The upper 3 may be glued in the shell 2 to prevent detachment of these two parts. More particularly, as can be seen in FIG. 1, the relatively rigid band formed by elements 5, 6, 7, and 8 provide an upwardly facing opening within which the upper 3 is received and affixed.

The relatively flexible upper 3 covers at least the top of the foot and extends upwardly so as to enclose the lower leg.

The upper 3 is kept in contact with the foot and the lower leg of the user by means of a conventional closing system 12, such as lacing.

Figure 3:
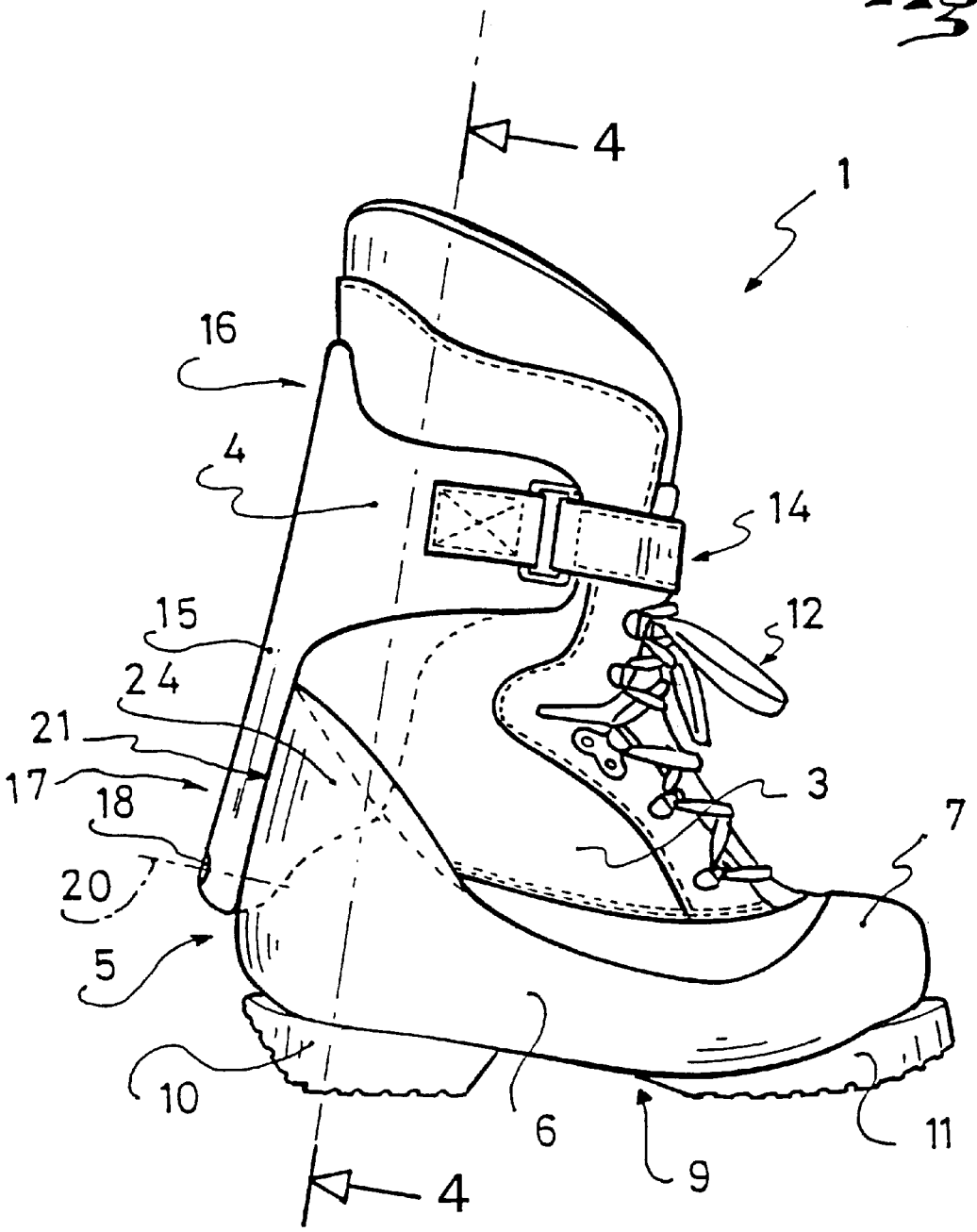
FIG. 3 is a side elevation view of the boot shown in FIG. 1.

The collar 4, which is preferably made of a relatively rigid material, encloses, or surrounds, the upper part 13 of the upper 3 and tightens over the ankle or lower leg of the user using a conventional tightening and closing system 14. Below a forwardmost part of the collar, i.e., beneath the tightening and closing system 14 of the collar 4 and above the shell 2, the rigid parts of the boot 1 provide an opening, as shown in FIGS. 1 and 3, whereby the closing system 12 of the flexible upper 3 is externally exposed.

A longitudinal stiffening piece 15 incorporated into the collar 4 extends substantially vertically from the upper part 16 to the lower part 17 of the collar 4.

This longitudinal stiffening piece 15 may be mounted on the collar 4 or, according to a preferred method of manufacture, the piece 15 and the collar 4 may form a single part made, for example, of a plastic material.

The longitudinal stiffening piece 15 allows the collar 14 to be articulated on the heel-piece 5 using a connection device, such as a pivot pin 18.

The pivot pin 18, which is represented in FIG. 1 by a circle can, in accordance with a non-limiting embodiment, be attached to the heel-piece 5 by inserting it in a hole 19 in the collar.

Figure 2:
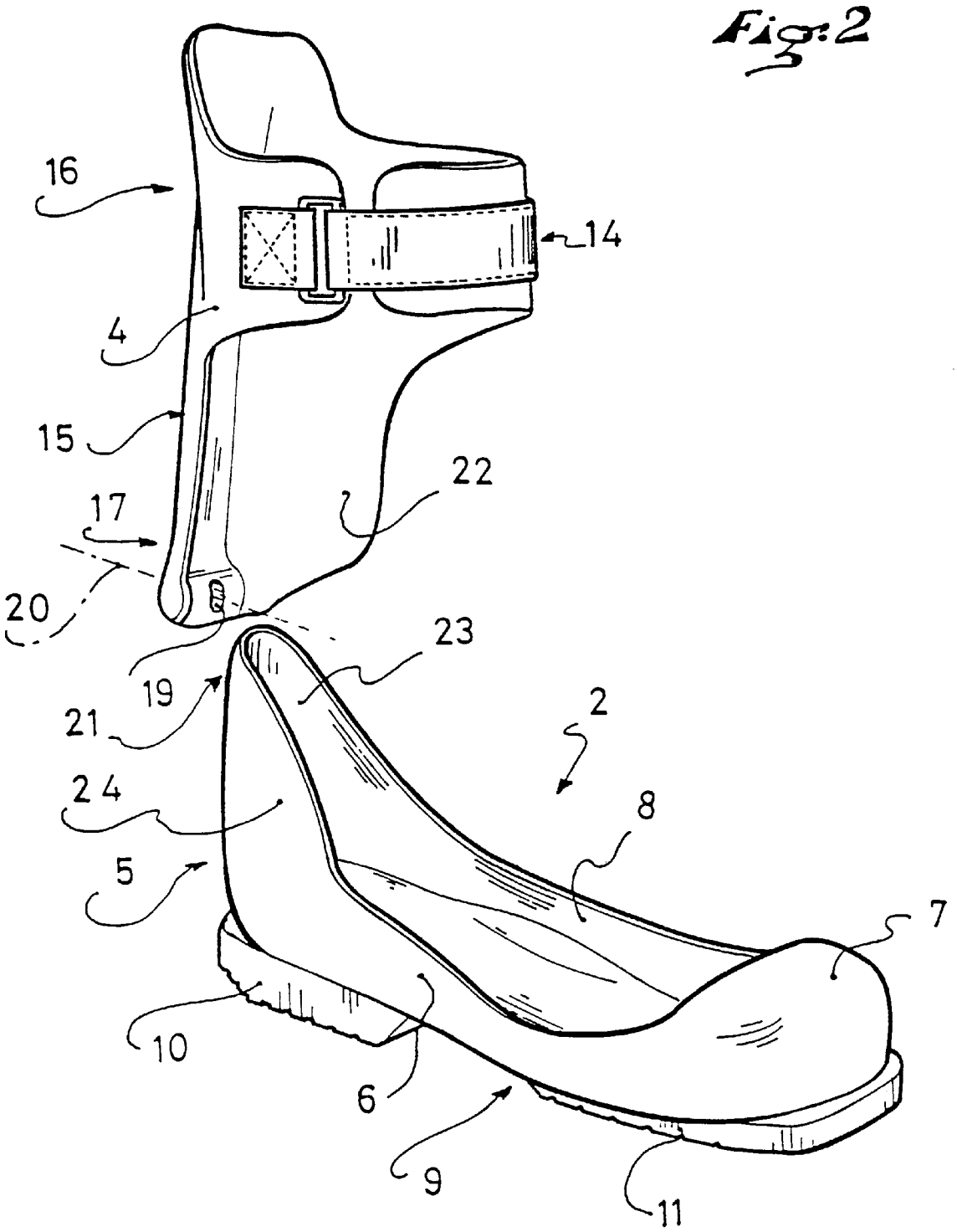
FIG. 2 is a front three-quarter perspective view which shows, in particular, a shell and a collar of the boot shown in FIG. 1.

The hole 19 is shown in FIG. 2, in which only the collar 4 and the shell 2 have been illustrated in an exploded view.

The axis 20 of the pivot pin 18 is located in a substantially longitudinal plane of the boot 1, so as to allow a lateral inclination of the collar 4 in relation to the shell 2, as will be described below.

According to a preferred embodiment, the axis 20 of the pivot pin 18 extends in a substantially horizontal direction. Accordingly, the axis 20 is approximately parallel to the sole 9, thereby allowing the user's leg to be held in a natural position.

In fact, a central area 21 of the structurally similar part or heel-piece 5 fastened to the sole 9 cooperates with the collar 4 by means of the longitudinal stiffening piece 15, in order to act as a longitudinal stop.

Consequently, bending of the foot around the ankle in relation to the leg is not possible in the longitudinal direction of the foot.

The user may thus easily be supported on the edges, since he has virtually no other forces to generate in order to preserve a stable position of the leg in relation to the foot.

FIG. 3, in which the boot is seen from the outside, allows an even better understanding of this phenomenon.

Figure 4:
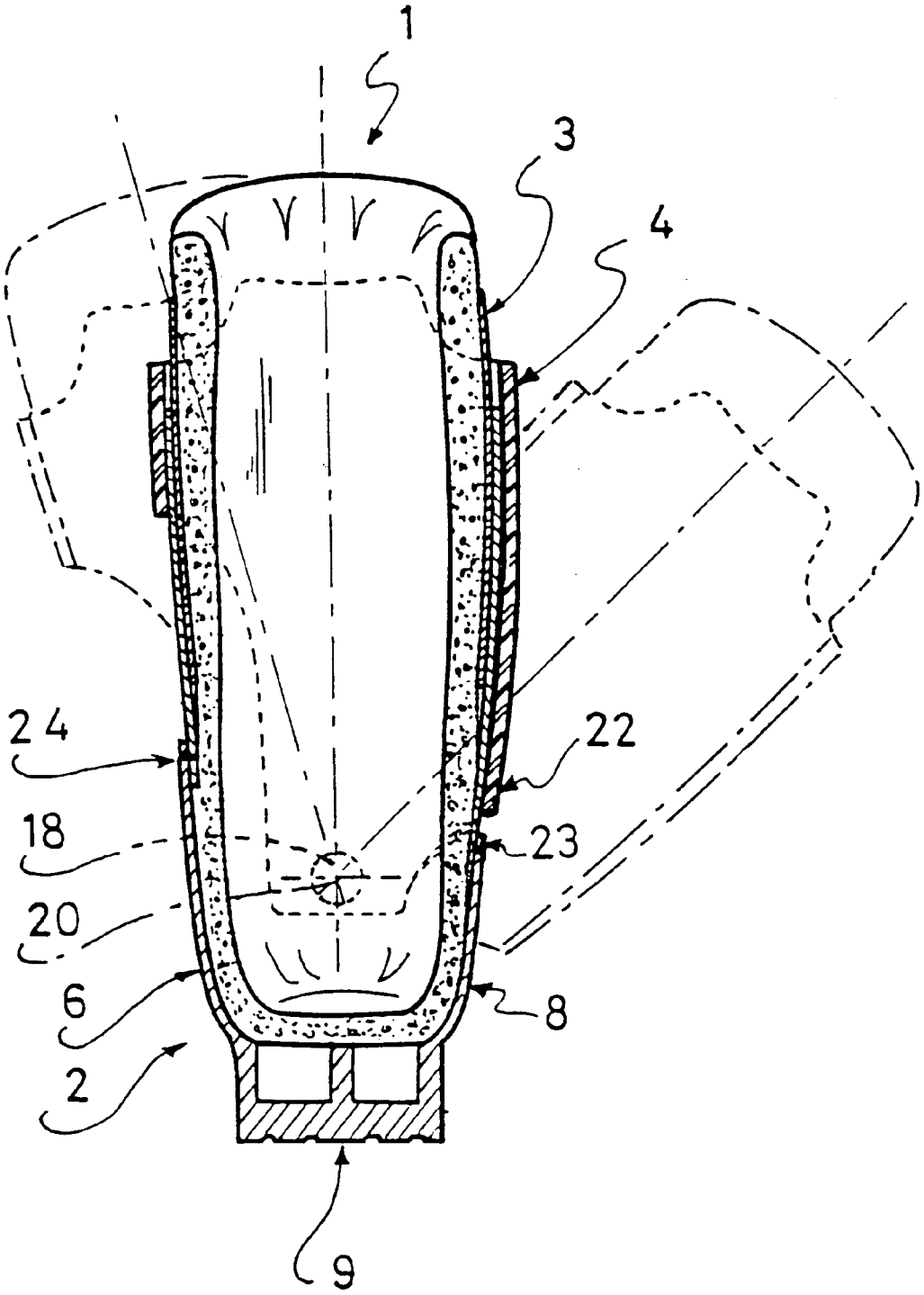
FIG. 4 is a transverse cross-sectional view taken along line 4—4 of FIG. 3.

Moreover, the user will be able more easily to steer the board or sliding device, or to adapt to external forces, since the pivot pin 18 allows lateral inclination of the collar 4, as was stated and illustrated in FIG. 4.

To this end, stop means restrict the angled movements of the collar 4 in at least one direction.

The collar 4 preferably comprises an inner lateral extension 22 that can cooperate with a lateral wall 23 of the heel-piece 5 in order to limit the outward angled motion of the collar 4.

This inner lateral extension 22 acts as a stop by being pressed against the lateral wall 23 of the heel-piece 5.

This is an important function, since the positions adopted by the user in relation to the board produce very pronounced inward inclinations of the leg, while the outward inclinations are less marked.

It is for this reason that the stop means are asymmetrical: the inner lateral extension 22 of the collar 4 extends in order to cover the lateral wall 23 of the heel-piece 5, while no extension begins at the longitudinal stiffening piece 15 to extend and cover a lateral wall 24 of the heel-piece 5 located on the exterior of the boot.

Figure 5:
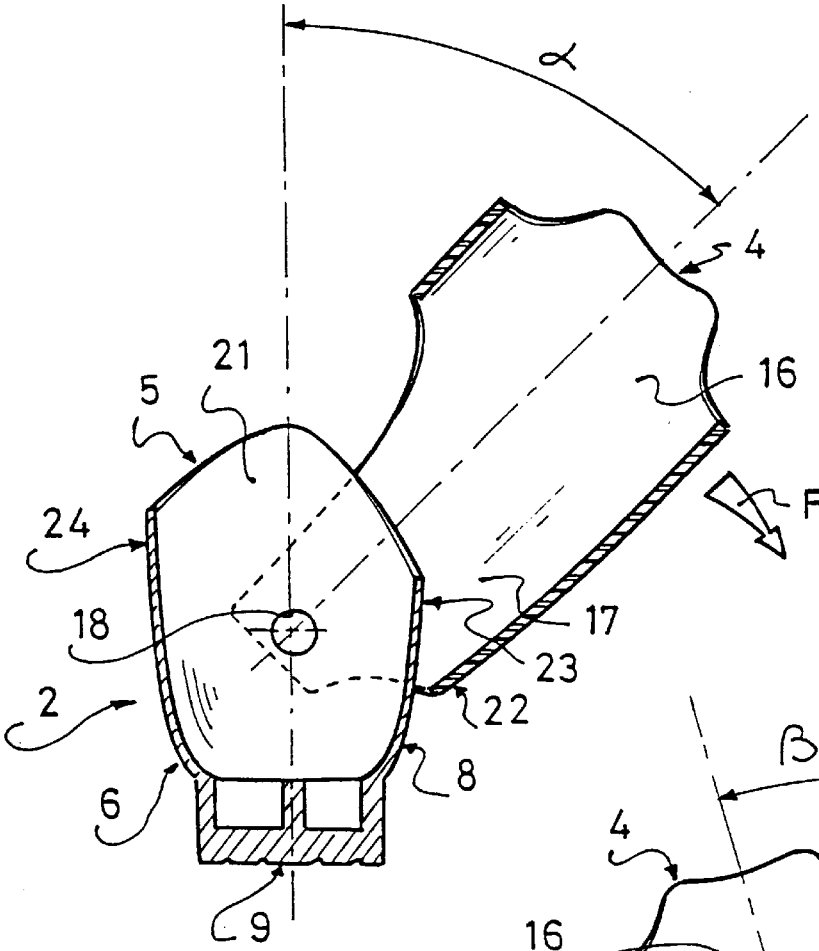
FIG. 5 is a view similar to that of FIG. 4, in which only the shell and the collar are shown, the collar having been pivoted toward the medial side of the boot.
Figure 6:
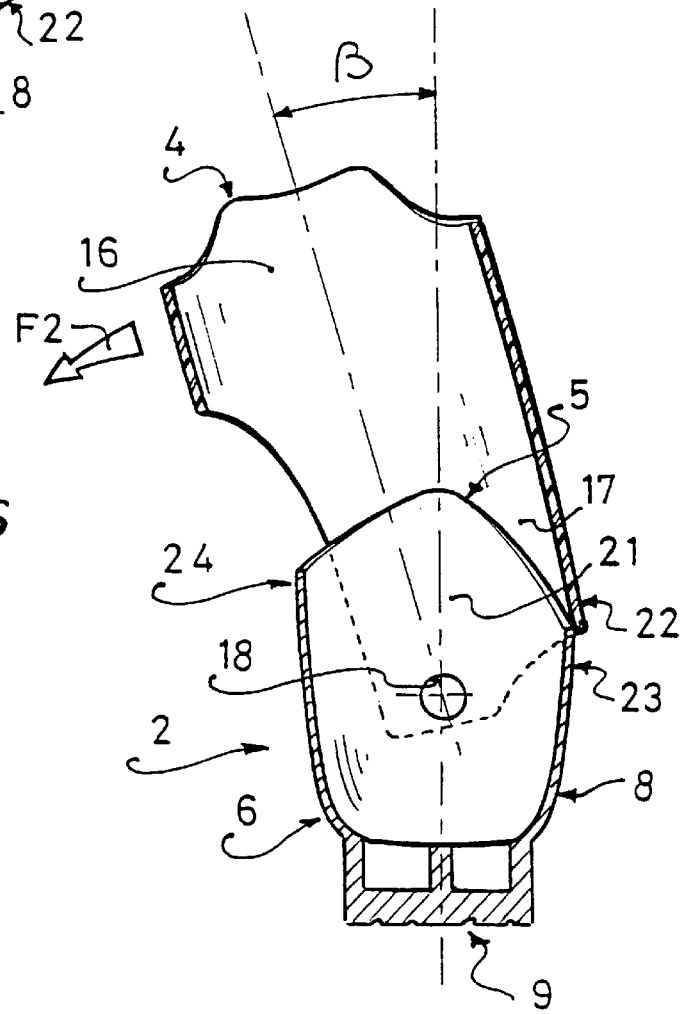
FIG. 6 is a view similar to that of FIG. 5, the collar been pivoted toward the lateral side of the boot.

The operation of the stop formed by the inner lateral extension 22 of the collar 4 is shown schematically in FIGS. 5 and 6.

FIG. 5 illustrates an inclination $\alpha$ of the collar 4 in relation to the shell 2 and extending toward the inside of the boot 1. This inclination occurs at an angle of between 0 and 50 degrees. It corresponds to a leg position which transmits a significant quantity of sensitive information to the user. For this reason, the collar 4 is guided in relation to the shell 2 only by the pivot pin 18. The absence of a stop restricting the angled movement of the collar 4 toward the inside of the boot is intended to avoid impeding the user.

On the other hand, as shown in FIG. 6, the inner lateral extension 22 usefully limits the angled movement of the collar 4 toward the outside of the boot 1, in order to enable the user to gain support to help him generate forces used to steer the board.

To this end, the inner lateral extension 22 located on the lower part 17 of the collar 4 on the inside of the boot 1 is supported on the inner lateral wall 23 of the heel-piece 5, in such a way that the angled movement $\beta$ of the collar 4 directed outwardly occurs within a range of between 0 and 20 degrees, zero corresponding to the vertical position of the collar 4.

In fact, when the collar 4 is inclined outwardly in the direction of the arrow F2, the inner lateral extension 22 of the collar 4 is pressed against the lower lateral wall 23 of the heel-piece 5, at the same time that, when the collar 4 is inclined inwardly in the direction of the arrow F1, the inner lateral extension 22 moves away from the heel-piece 5 and is thus made inoperative.

It is possible to adjust the value of the angled inclination of the collar 4 by changing the height of the heel-piece 5. The heel-piece 5 is preferably asymmetrical, and the area of the heel-piece 5 located to the outside, or lateral side, of the boot 1 is higher than the area located to the inside, or medial side, of the boot 1, in relation to the sole 9.

In other words, the outer lateral wall 24 of the heel-piece 5 is higher than the inner lateral wall 23 in relation to the sole 9.

As described above, this arrangement makes it possible, on the one hand, to provide a stop-motion function toward the outside of the boot 1 and, on the other hand, it promotes a significant inward swinging motion.

In fact, the upper 3 undergoes pronounced lateral flection when the leg inclines inwardly. The height difference between the two sides of the heel-piece facilitates internal flection of the upper 3 without damaging the boot 1.

The invention is not limited to the specific embodiment described above and includes all technical equivalents that fall within the scope of the following claims.

The invention is not limited to use as a snowboarding boot and can be implemented in all sliding sports having substantially the same requirements as snowboarding.

What is claimed is:

1. A boot for a gliding sport comprising:

a relatively rigid shell including a sole and a heel part;

a relatively flexible upper received in said shell and having an upper part for receiving a lower leg;

a relatively rigid collar extending rearwardly of the lower leg;

said rigid collar having a connection for continuous movement with respect to said rigid shell along a substantially longitudinally extending axis during practice of said gliding sport.

2. A boot according to claim 1, wherein:

a lower portion of said flexible upper is fixed against movement with respect to said sole of said shell.

3. A boot according to claim 1, wherein:

said connection is a pivot connection for continuous pivoting of said rigid collar about a substantially horizontal axis.

4. A boot according to claim 1, wherein:

said boot comprises an engagement structure that limits angled movement of said collar in at least one transverse direction.

5. A boot according to claim 4, wherein:

said engagement structure is asymmetrical with respect to a substantially longitudinal plane.

6. A boot according to claim 5, wherein:

said engagement structure includes an inner lateral extension of said collar positioned for engagement with a lateral wall of said heel part of said rigid shell to limit said angled movement of said collar.

7. A boot according to claim 6, wherein:

said transverse direction of said lateral angled movement of said collar is an outward direction, said lateral angled movement occurs in a range of 0° to 20° from a vertical plane.

8. A boot according to claim 1, wherein:

said heel part is asymmetrical, is fastened against movement with respect to said sole, said heel part including an area located laterally on said boot which is higher than an area located medially on said boot, in relation to said sole.

9. A boot according to claim 1, wherein:

said heel part is fastened to said sole and cooperates with said collar to act as a stop under longitudinal flection.

10. A boot for a gliding sport comprising:

a relatively rigid shell including a sole, a heel part, and a front end, said rigid shell having an upwardly facing opening extending in a longitudinal direction between said heel part and said front end;

a relatively flexible upper received in said upwardly facing opening of said shell and having an upper part for receiving a lower leg;

a relatively rigid collar extending upwardly of said rigid shell and being positioned rearwardly of the lower leg, said upwardly facing opening of said rigid shell extending forwardly of a forwardmost part of said rigid collar;

said rigid collar being movable with respect to said rigid shell during practice of said gliding sport in a direction transverse to said longitudinal direction.

11. A boot according to claim 10, wherein:

said rigid collar is connected to said rigid shell by means of a pivot connection for articulation of said rigid collar along a substantially longitudinally extending axis during said practice of said gliding sport.

12. A boot according to claim 10, wherein:

said rigid shell further comprises an outer wall and an inner wall, said rigid shell forming a relatively rigid band by means of said front end, said heel part, and said outer and inner walls; and said rigid band holds a lower part of said upper in place against movement relative to said band.

13. A boot for a gliding sport according to claim 12, wherein:

said upper is affixed to said band with glue.

14. A boot for the practice of snowboarding, the boot comprising:

(a) a relatively rigid shell comprising a sole and a heel part;

(b) a relatively flexible upper received in said shell and having an upper part enclosing a lower leg of the user;

(c) a relatively rigid collar surrounding said upper part of said upper, and being articulated on said heel part of said shell by a pivot pin;

(d) said pivot pin having an axis extending in a plane substantially longitudinal to said boot, so as to allow continuous lateral/medial inclination of said collar in relation to said shell when said collar is closed during practice of the sport.

15. A boot according to claim 14, wherein said axis of said pivot pin extends substantially horizontally.

16. A boot according to claim 14, wherein said boot comprises stop means for limiting angled movement of said collar in said at least one direction.

17. A boot according to claim 16, wherein said stop means are asymmetrical.

18. A boot according to claim 7, wherein said collar comprises an inner lateral extension capable of cooperating with a lateral wall of said heel part in order to limit the angled movement of said collar laterally of said boot.

19. A boot according to claim 18, wherein lateral angled movement of said collar occurs in a range of 0° to 20° from a vertical position of said collar.

20. A boot according to claim 14, wherein said heel part is asymmetrical, is fastened to said sole, and comprises an area located laterally on said boot which is higher than an area located medially on said boot, in relation to said sole.

21. A boot according to claim 14, wherein said pivot pin is constituted by a cylindrical member articulated to said heel part in a hole in said collar.

22. A boot according to claim 14, wherein said heel part is fastened to said sole and cooperates with said collar to act as a stop under longitudinal flection.

23. A snowboarding boot for the practice of the sport of snowboarding, said snowboarding boot comprising:

a relatively rigid shell including a sole and a heel part;

a relatively flexible upper received in said shell and having an upper part enclosing a lower leg;

a relatively rigid collar extending rearwardly of the lower leg;

said rigid collar having a pivot connection with respect to said rigid shell for continuous articulation along a substantially longitudinally extending axis during said practice of snowboarding with said snowboarding boot.

24. A snowboarding boot according to claim 23, wherein to a lower portion of said flexible upper is fixed against movement with respect to said sole of said shell.

25. A boot according to claim 23, wherein said axis extends substantially horizontally.

26. A boot according to claim 23, wherein said boot comprises an engagement structure that limits angled movement of said collar in at least one transverse direction.

27. A boot according to claim 26, wherein said engagement structure is asymmetrical with respect to a substantially longitudinal plane.

28. A boot according to claim 27, wherein said engagement structure includes an inner lateral extension of said collar positioned for engagement with a lateral wall of said heel part of said rigid shell to limit said angled movement of said collar.

29. A boot according to claim 28, wherein said transverse direction of said lateral angled movement of said collar is an outward direction, said lateral angled movement occurs in a range of 0° to 20° from a vertical plane.

30. A boot according to claim 23, wherein said heel part is asymmetrical, is fastened against movement with respect to said sole, said heel part including an area located laterally on said boot which is higher than an area located medially on said boot, in relation to said sole.

31. A boot according to claim 23, wherein said heel part is fastened to said sole and cooperates with said collar to act as a stop under longitudinal flection.

32. A snowboarding boot for the practice of the sport of snowboarding, said snowboarding boot comprising:

a relatively rigid shell including a sole and a heel part;

a relatively flexible upper received in said shell and having an upper part enclosing a lower leg, said flexible upper having a closing system;

a relatively rigid collar extending rearwardly of the lower leg;

said rigid collar having a pivot connection with respect to said rigid shell for articulation along a substantially longitudinally extending axis during said practice of snowboarding with said snowboarding boot.

33. A snowboarding boot according to claim 32, wherein a forwardmost part of said rigid collar is spaced from said rigid shell, whereby said closing system of said flexible upper is externally exposed.

34. A snowboarding boot according to claim 33, wherein said collar has a tightening and closing system at said forwardmost part of said collar and said closing system of said flexible upper is positioned beneath said tightening and closing system of said collar.

35. A snowboarding boot according to claim 32, wherein said closing system of said flexible upper comprises lacing.

36. A snowboarding boot for the practice of the sport of snowboarding, said snowboarding boot comprising:

a relatively rigid shell including a sole and a heel part;

a relatively flexible upper received in said shell and having an upper part enclosing a lower leg;

a relatively rigid collar extending rearwardly of the lower leg, a forwardmost part of said rigid collar being spaced above said rigid shell, thereby exposing a forward portion of said flexible upper;

said rigid collar having a pivot connection with respect to said rigid shell for articulation along a substantially longitudinally extending axis during said practice of snowboarding with said snowboarding boot.

37. A snowboarding boot according to claim 36, wherein said relatively rigid shell further includes a front end, an outer lateral wall and an inner lateral wall, whereby said heel part, said front end, said outer lateral wall and said inner lateral wall form a relatively rigid band being upwardly facing opening between said front end and said heel part, said relatively flexible upper being received within said upwardly facing opening of said relatively rigid band.

* * * * *